United States Patent [19]

Tsukamoto

[11] Patent Number: 4,586,223

[45] Date of Patent: May 6, 1986

[54] MACHINE FOR STRAIGHTENING AND POLISHING A ROUND BAR

[76] Inventor: Kotaro Tsukamoto, 6-54, Toneyama 6-chome, Toyonaka-City, Osaka Prefecture, Japan

[21] Appl. No.: 644,676

[22] Filed: Aug. 27, 1984

[51] Int. Cl.[4] ..... B24B 39/04

[52] U.S. Cl. ..... 29/90.5; 29/33 F; 51/117

[58] Field of Search ..... 29/33 F, 33 S, 33 Q, 29/90.5; 51/5 A, 110, 112, 117; 72/98

[56] References Cited

U.S. PATENT DOCUMENTS

| | | | |
|---|---|---|---|
| 603,836 | 5/1898 | Alego, Jr. | 20/90.5 X |
| 683,109 | 9/1901 | Dutton | 29/90.5 X |
| 1,901,829 | 3/1933 | Gaisman | 51/112 |
| 2,105,637 | 1/1938 | Davis | 51/117 X |
| 2,194,757 | 3/1940 | Klaas et al. | 51/112 X |
| 2,239,580 | 4/1941 | Statz | 51/5 A |
| 2,355,174 | 8/1944 | Nye et al. | 51/112 |

FOREIGN PATENT DOCUMENTS

| | | | |
|---|---|---|---|
| 2416768 | 10/1979 | France | 51/112 |

*Primary Examiner*—Fred Silverberg

*Attorney, Agent, or Firm*—Wenderoth, Lind & Ponack

[57] ABSTRACT

A machine for straightening and polishing a round bar comprises a bed, a plurality of straighteners, and a plurality of squeezing-and-rubbing machines. A pair of polishing discs face each other on rotating shafts extending from the squeezing-and-rubbing machines. Central longitudinal axes of the rotating shafts upon which the pair of facing polishing discs are mounted are offset from but parallel to each other and rotate in the same direction. Thus, the round bar is straightened while being passed through the straightening tubes and is polished while being rotated by the polishing discs.

1 Claim, 5 Drawing Figures

MACHINE FOR STRAIGHTENING AND POLISHING A ROUND BAR

BACKGROUND OF THE INVENTION

As a machine tool for beautifully polishing up the surface of round bar metals and other metal products, there has been in use a machine commonly known as the grinder. Since, however, its function is to grind off the surface of a workpiece which is pressed against a rotating grinding wheel to polish it up, it is primarily employed for the purpose of removing flaws on the surface of a workpiece or of reducing products to correct dimensions and it was impossible to beautifully polish up the surface of round bar metals drawn to a specified diameter, that is, to give it a good shine without changing the diameter.

SUMMARY OF THE INVENTION

An object of the present invention is to provide a polishing machine which, unlike the existing grinder as mentioned above, is so devised as to be capable of polishing up the surface of round bar metals without grinding it off.

Another object of this invention is to provide a polishing machine wherein round bar metals are passed between several pairs of rotating metal discs which serve to squeeze and rub their uneven surfaces, thereby to beautifully polish it up, that is, to give it a good shine, without causing a change in their diameters.

Still another object of the invention is to provide a polishing machine which is capable of raising the degree of straightness of round bar metals simultaneously with the polishing of their surfaces with metal discs as stated above.

The present invention has been made to attain such objects, and its composition in concrete terms will be further clarified by a detailed description of the invention, with reference to the accompanying drawings, given below.

DETAILED DESCRIPTION OF THE INVENTION

Figure 1:
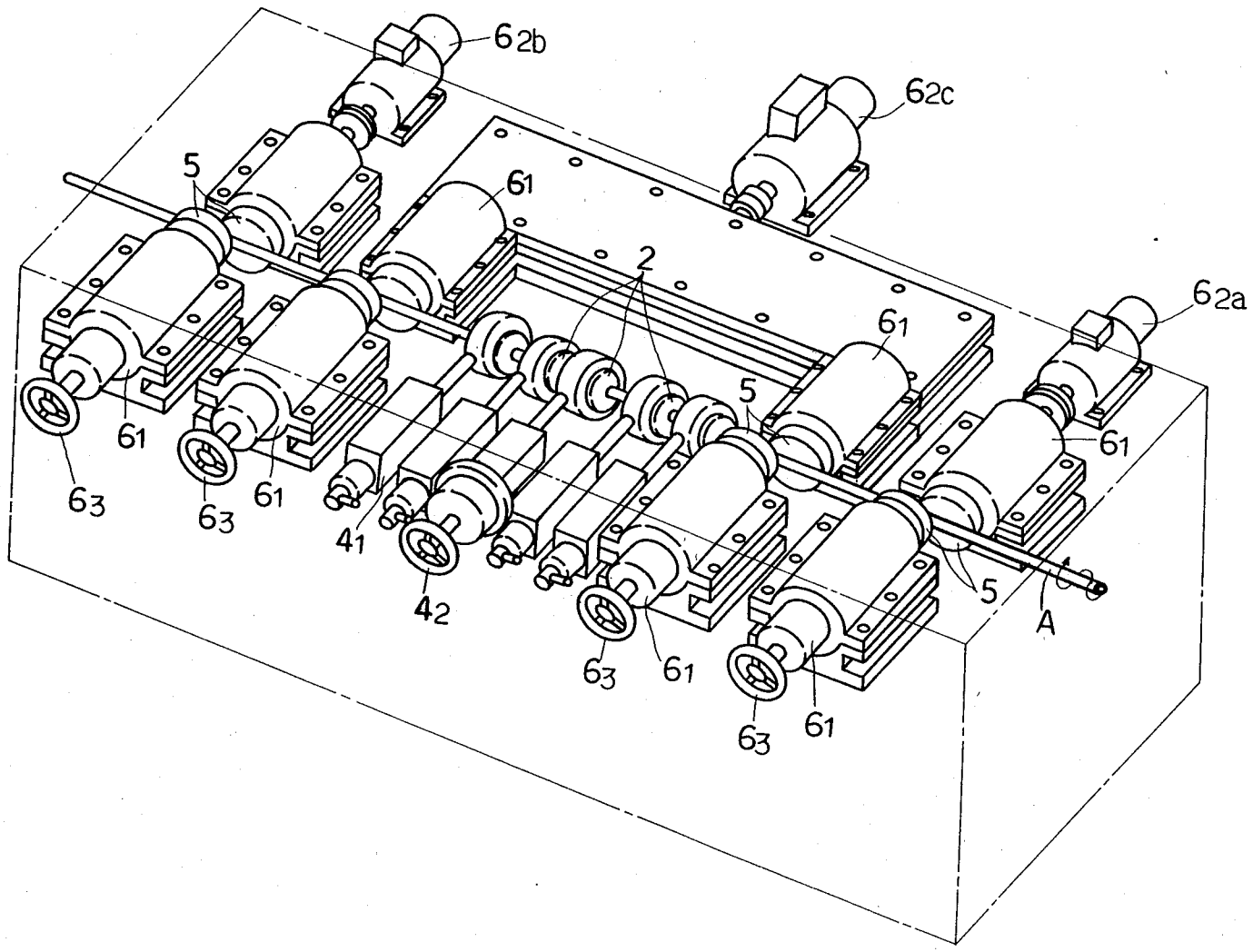
FIG. 1 is a perspective view of the whole machine of the present invention.
Figure 2:
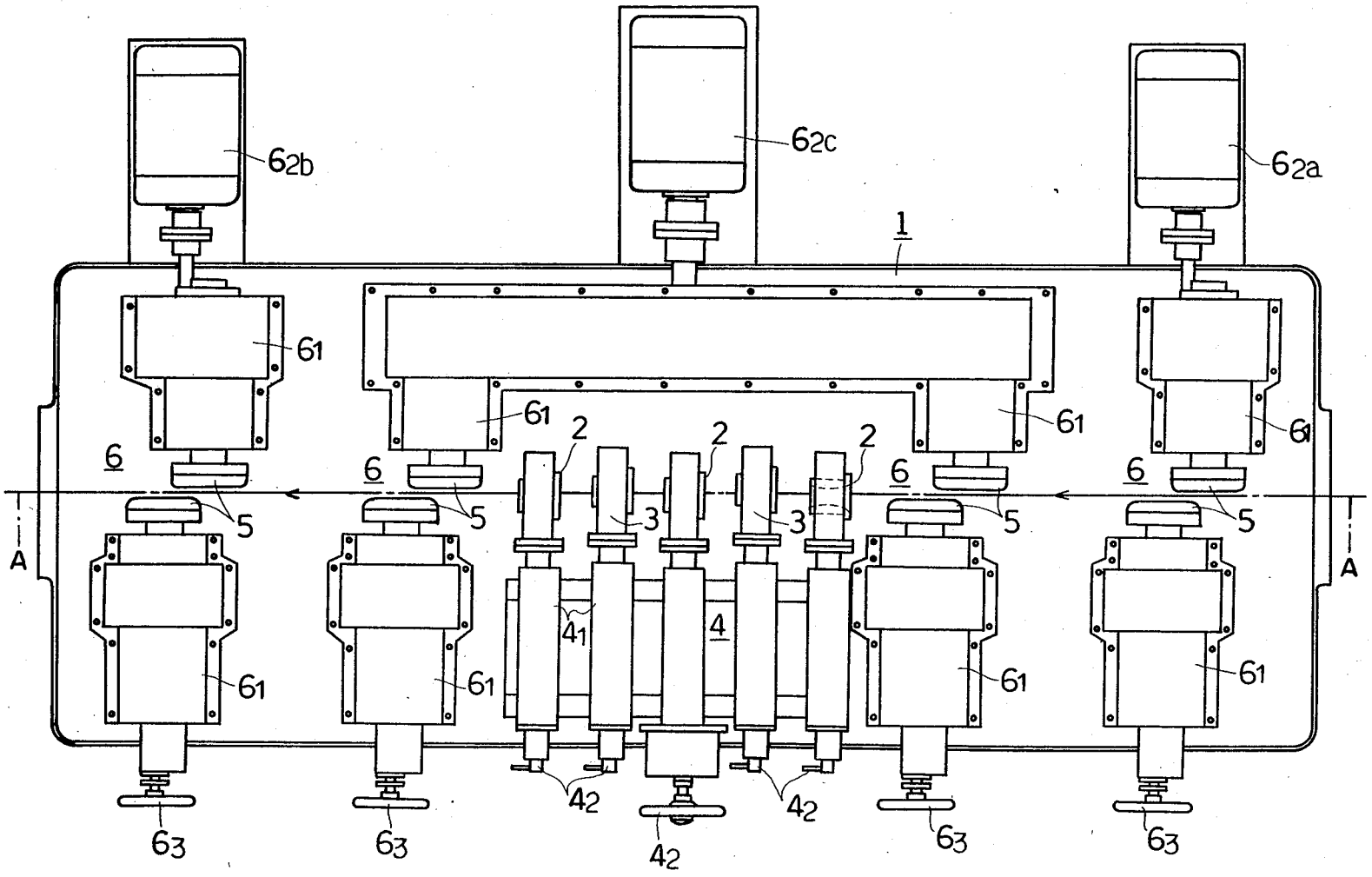
FIG. 2 is a plan view of the said machine.

In FIG. 2 of the accompanying drawings, the numeral 1 indicates the base of the machine. At the center of said base 1, there is arranged a plurality of straighteners 4, each straightener 4 comprising a nozzle-like straightening tube 2 through which a round bar "A" is passed and which is rotatably supported by a supporting rod 3, said rod 3 being capable of sliding horizontally at a right angle to the passing round bar "A". At the fore and rear parts of the base 1, there are arranged two units each of squeezing-and-rubbing machines 6, one such machine comprising a pair of metal discs 5 . . . 5 which are constructed in such a manner that the space between them is adjustable so as to allow the round bar "A" to pass between them in close contact with a part of them.

Figure 3:
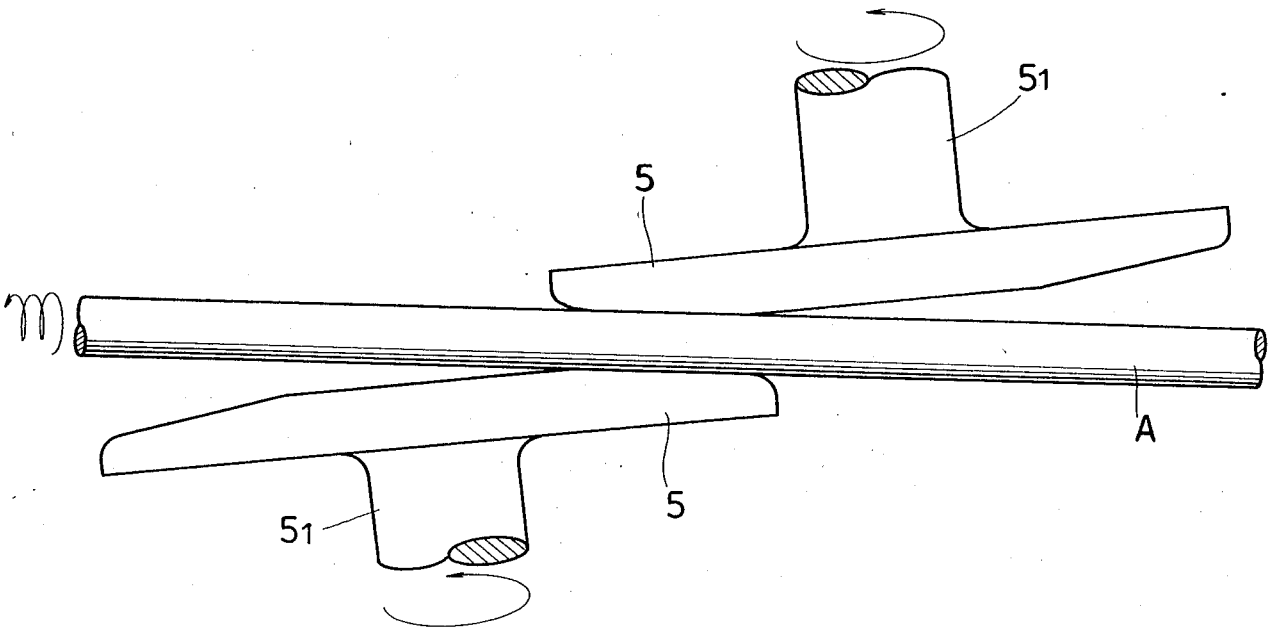
FIG. 3 is an enlarged view of a pair of metal discs polishing a round bar.

As shown in FIG. 3, the two discs 5 face each other with an offset between the parallel longitudinal axes of their rotating shafts $5_1$ . . . $5_1$ and rotating in the same direction. The rotating speed of the metal discs 5 . . . 5 of the squeezing-and-rubbing machine 6 at the rear end is made higher than that of the metal discs 5 . . . 5 of other squeezing-and-rubbing machines 6 . . . 6.

To go into further details of the construction of the machine as shown in FIG. 2 the straightener 4 is constructed in such a manner that the nozzle-like straightening tube 2, which is capable of passing the round bar "A" through it, is rotatably supported, through the medium of bearings, by the supporting rod 3 which is capable of sliding horizontally, being guided by the cylindrical body $4_1$ of the straightener 4, the amount of protrusion of the supporting rod 3 being adjustable by manipulation of a handle $4_2$. Thus, in addition to its primary function of straightening bends of the round bar "A" which runs through the straightening tube 2, rotating on its own axis, the straightener 4 also serves to polish the surface of the round bar A by rubbing it with the inner wall of straightening tube 2.

The squeezing-and-rubbing machine 6, on the other hand, consists of a pair of machine bodies $6_1$ . . . $6_1$ facing each other across the passage of round bars A with an offset in the direction of the passing of round bars A and metal discs 5 . . . 5 rotatably supported by the respective machine bodies $6_1$. There are installed on the base 1, in a suitable manner, three DC motors $6_{2a}$, $6_{2b}$ and $6_{2c}$; and by running these motors, the rotating shafts $5_1$ FIGS. 3 and 4) of the metal discs 5 are rotated with their longitudinal axes parallel to each other, through the transmission gearing, at the same speed respectively. Of four, in all, of the squeezing-and-rubbing machines 6 . . . 6, two are disposed before the straighteners 4 . . . 4, and the other two after them. The foremost and the hindmost squeezing-and-rubbing machines 6 . . . 6 are independently driven by the motors $6_{2a}$ and $6_{2b}$ respectively, and the other two squeezing-and-rubbing machines 6 . . . 6 inside are driven by a single motor in common, namely, the motor $6_{2c}$. Thus, there can be made of difference in speed of rotation of the metal discs 5 . . . 5 between the squeezing-and-rubbing machine 6 at the fore end, namely, at the inlet, those two inside and that at the rear end, namely, at the outlet. Further, one of the pair of machine bodies $6_1$ of the squeezing-and-rubbing machine 6 is provided with a handle $6_3$ for adjustment of the space between the metal discs 5 . . . 5; and by manipulation of this handle $6_3$, the force applied by the discs 5 on the passing round bar "A" is adjusted.

Following is a description, in concrete terms, of the use, action and effects of a machine embodying the present invention, with reference to the accompanying drawings and to the explanation of its construction given above.

Figure 4:
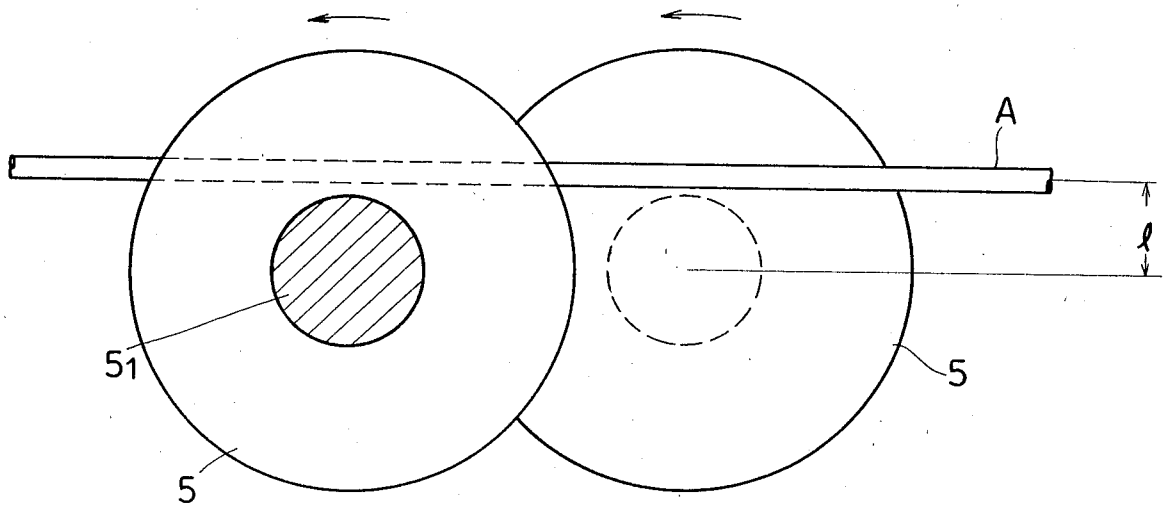
FIG. 4 is a front view of said pair of metal discs.
Figure 5:
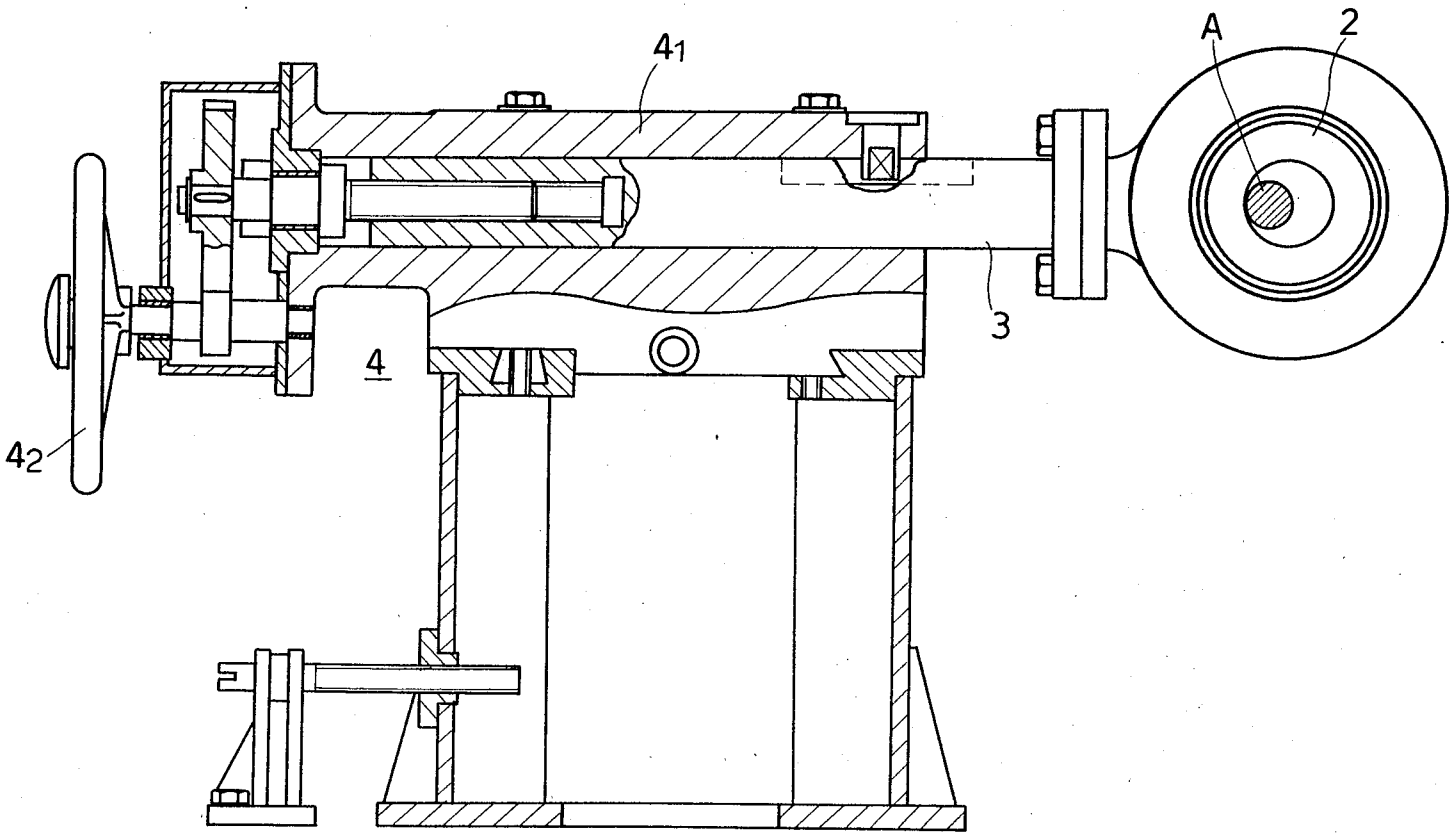
FIG. 5 is a lateral view of the longitudinal section of a straightener which is a constituent unit of the polishing machine of the present invention.

To begin with, the spacing of the metal discs 5 . . . 5 of the squeezing-and-rubbing machines 6 . . . 6 is adjusted, by manipulating the handles $6_3$ . . . $6_3$, so as to suit the diameter of the round bar "A" to be polished; and then the motors $6_{2a}$, $6_{2b}$ and $6_{2c}$ are switched on to rotate the metal discs 5 . . . 5, as shown in FIGS. 3 and 4, in the direction of an arrow, that is, counterclockwise. Subsequently, the round bar "A", which was drawn to the specified diameter and cut to the specified length in the preceding process, is sent, by means of a conveyor (not illustrated), in between the metal discs 5 . . . 5 of the squeezing-and-rubbing machine 6 at the inlet of the line as shown in FIG. 4, the round bar "A" is moved in the same direction as that of the rotation of the metal discs 5 . . . 5 at a speed corresponding to the circumferential speed at the distance "1" from the center of the metal disc 5 to the center of the round bar A and is, at the same time, given the power of rotating on its own axis by the metal discs 5 . . . 5. Thus the round bar "A" is sent in between the metal discs 5 . . . 5 of the next squeezing-and-rubbing machine 6 while rotating on its own axis. As the round bar A rotates like this, those parts of the bar A which are larger in diameter than the dimension of the space between the metal discs 5 . . . 5, that is to say, raised parts on its periphery, if there is any, are squeezed and are spirally rubbed on to other parts of the periphery. Thus the diameter is made uniform and, at the same time, the periphery is rubbed and polished. The same action is done also by the next, namely, the second squeezing-and-rubbing machine 6 shown in FIG. 2. As the bar A is sent out from the second squeezing-and-rubbing machine 6, it passes through the straightening tubes 2 . . . 2 of the straighteners 4 . . . 4 disposed at the center of the base 1. During this process, bends of the bar A are straightened and its surface is polished by friction with the inner wall of straightening tubes 2. The round bar "A" which has passed through the straighteners 4 . . . 4 is further polished up by the two more squeezing-and-rubbing machines 6 . . . 6 disposed at the rear part of the base 1. The rotating speed of the metal discs 5 . . . 5 of the hindmost squeezing-and-rubbing machine 6, namely, the one at the outlet of the line, is set at a higher level than that of the other metal discs 5 . . . 5, so there arises a gap between it and the speed at which the round bar A has so far been rotating and progressing, causing a slippage to occur. By this slippage, the bar A is rubbed still more effectively and is polished up beautifully. If the rotating speed of the metal discs 5 . . . 5 of the foremost squeezing-and-rubbing machine 6, namely the one at the inlet of the line, is made slower than that of the metal discs 5 . . . 5 of the two squeezing-and-rubbing machines 6 inside, the polishing effect will be heightened still further.

As explained in the foregoing, with the polishing machine of the present invention, the method adopted is, unlike the method of the conventional grinder in which the workpiece is polished up by grinding it off, to polish up the surface of round bars A by squeezing those parts of the bar A which are larger in diameter to rub them on to other parts, thereby making the diameter uniform, and by rubbing the surface. Thus, it is possible to polish up the surface of round bars A which were drawn to the specified diameter by the drawing machine, without causing a change in their diameter, thereby enhancing the value of products. The work on this machine can be carried out as a continuous process of the drawing work; and, since the system comprises a straightener unit, it is possible to highten the degree of straightness of round bar metals A simultaneously with their polishing. The use of the polishing machine of the present invention has little effect on the price of products; and in spite of the fact that there is little difference in price between the products worked by this machine and those as drawn, it has such an excellent effect that it can furnish beautifully shined-up products with high degree of straightness.

It may be added that the relationship between the running speed and the rotating speed of the round bar "A" passing between the metal discs 5 . . . 5 is governed by the distance "1" from the center of the metal disc 5 to the center of the round bar "A". The smaller the value of "1", the higher is the rotating speed of the bar A and the slower its running speed; while the larger the value of "1", the slower is the rotating speed of the bar A and the higher its running speed. Thus, it is advantageous to pass the round bar A nearer to the center of the metal discs 5 . . . 5 in respect of the polishing effect, but this arrangement will be attended with a disadvantage in that the running speed of the bar A becomes slower and it takes A longer time to work. Therefore, the setting of the value of "1" and the rotating speed of the metal discs 5 will have to be done after repetition of several tests.

What is claimed is:

1. A machine for straightening and polishing a round bar, said machine comprising:

a base;

a plurality of straighteners arranged parallel to each other on the base;

a plurality of rods, each extending parallel to each other from the plurality of straighteners;

a plurality of nozzle-like straightening tubes, each being rotatably supported by one of the plurality of rods such that central longitudinal axes of the nozzle-like straightening tubes are coaxially aligned with each other so that the round bar may be passed through the plurality of nozzle-like straightening tubes;

a plurality of squeezing-and-rubbing machines arranged on the base, at least one of said squeezing-and-rubbing machines being placed before and at least one being placed after the plurality of straighteners;

a plurality of rotating shafts, each extending from one of the plurality of squeezing-and-rubbing machines and each having a central longitudinal axis; and at least one pair of polishing discs being mounted on the plurality of rotating shafts with a separating space sufficient to allow the round bar to pass between the at least one pair in close contact with a part of each of said discs;

said at least one pair of polishing discs facing each other and said central longitudinal axes of the rotating shafts upon which said facing polishing discs are mounted being offset from but parallel to each other and rotating in the same direction so that the round bar being passed between the at least one pair of facing polishing discs is rotated;

whereby the round bar is straightened while being passed through the plurality of straightening tubes and is simultaneously polished while being rotated by the polishing discs.

* * * * *